US005761824A

United States Patent [19]

Moon et al.

[11] Patent Number: 5,761,824

[45] Date of Patent: Jun. 9, 1998

[54] HAIR MOISTURIZING ATTACHMENT FOR USE WITH A HAIR DRYER

[75] Inventors: Jung S. Moon, Buffalo Grove, Ill.; Tae Wha Lee, Seoul, Rep. of Korea

[73] Assignee: IBC USA, Inc., Elk Grove Village, Ill.

[21] Appl. No.: 791,851

[22] Filed: Jan. 31, 1997

[51] Int. Cl.[6] ..... A45D 24/10

[52] U.S. Cl. ..... 34/97

[58] Field of Search ..... 34/96, 97, 99; 392/380, 384, 385; 132/212, 271, 272

[56] References Cited

U.S. PATENT DOCUMENTS

| | | | |
|---|---|---|---|
| 3,889,693 | 6/1975 | Tanaka et al. | 34/97 X |
| 3,905,379 | 9/1975 | Churas et al. | 132/272 |
| 4,230,279 | 10/1980 | Forsberg | 239/559 |
| 4,287,673 | 9/1981 | Wolter | 34/97 |
| 4,295,283 | 10/1981 | Tomaro . | |
| 4,391,047 | 7/1983 | Janssens et al. | 34/97 |
| 4,590,687 | 5/1986 | Caruso | 34/97 |
| 4,605,019 | 8/1986 | Reynolds et al. | 132/272 |
| 4,759,135 | 7/1988 | Scivoletto | 34/97 |
| 4,848,007 | 7/1989 | Montagnino | 34/97 |
| 5,036,601 | 8/1991 | Mulle, Jr. et al. | 34/97 |
| 5,060,398 | 10/1991 | Wolens | 34/90 |
| 5,235,759 | 8/1993 | Rizzuto, Jr. | 34/97 |
| 5,275,339 | 1/1994 | Andis et al. | 239/443 |
| 5,287,635 | 2/1994 | Chan | 34/97 |
| 5,303,483 | 4/1994 | Chan | 34/97 |
| 5,572,800 | 11/1996 | West | 34/97 |

*Primary Examiner*—Henry A. Bennett
*Assistant Examiner*—Steve Gravini
*Attorney, Agent, or Firm*—Gifford, Krass, Groh, Sprinkle, Patmore, Anderson & Citkowski, P.C.

[57] ABSTRACT

A moisturizing attachment for use with a conventional hand held hair dryer, the hair dryer having a handle portion and an air emitting nozzle portion. The attachment includes an internally hollowed body having a first end with a first annular lip portion and a second end with a second annular lip portion. The attachment is secured to an end of the hair dryer nozzle portion and a moisturizing insert is arranged within the body to intercept a flow through path of the heated air from the hair dryer. The moisturizing means is pre-immersed in a fluid such as water and is arranged within the attachment body such that, upon activation of the hair dryer, a steady stream of a micro vapor spray mist is issued from the attachment and operates to partially replenish the moisture content within the user's hair without interfering with the desired function of the hair dryer.

16 Claims, 4 Drawing Sheets

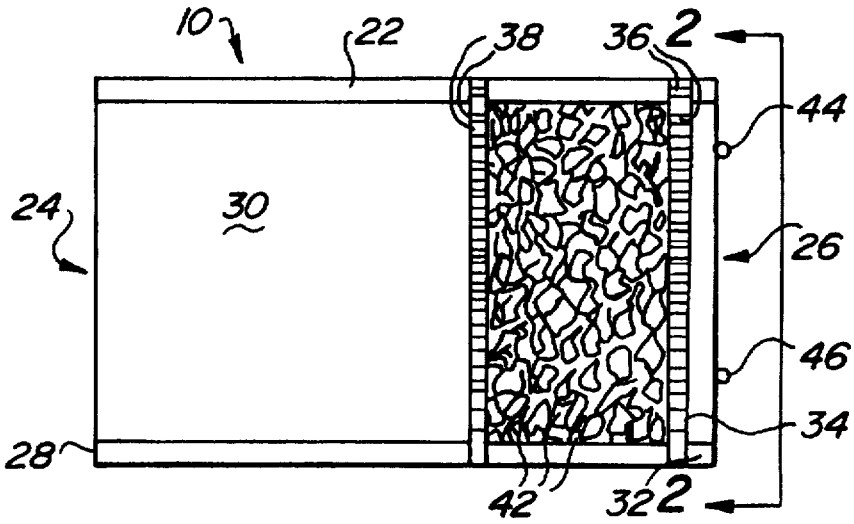
Fig-1
Fig-2
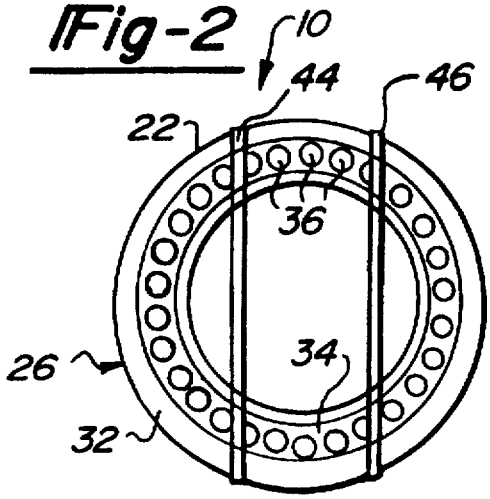
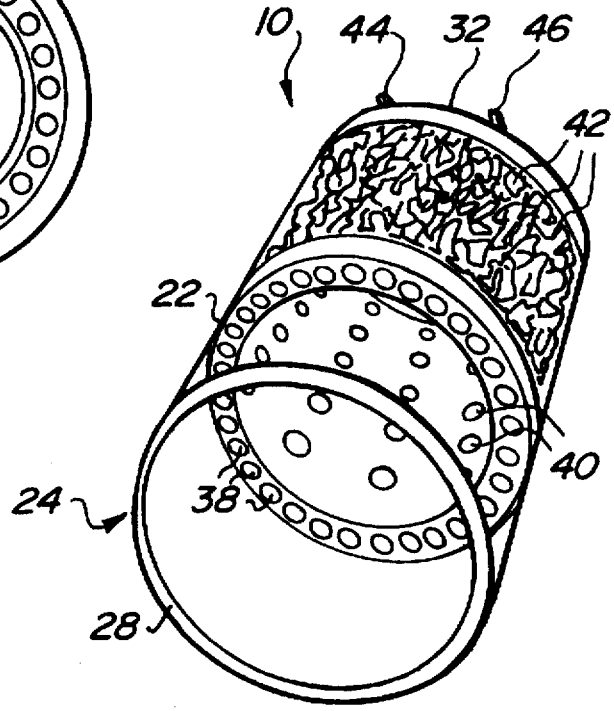
Fig-3

HAIR MOISTURIZING ATTACHMENT FOR USE WITH A HAIR DRYER

BACKGROUND OF THE PRESENT INVENTION

1. Field of the Invention

The present invention relates generally to hair dryer attachment devices and, more particularly, to a moisturizing attachment device for use with a hair dryer which maintains moisture balance in hair follicles.

2. Description of the Prior Art

Hair dryer attachment devices are fairly well known in the art for use with conventional hand held hair dryers. A common use of such attachments is to provide air diffusion and/or volumizing to a user's hair and primary examples of such devices are well known in the prior art. Typically, such devices are attached to an air emitting portion of a hair dryer and serve to redirect the air flow in some desired fashion to suit the user's needs.

A drawback of the conventional portable hand held hair dryer is that it tends to dry all moisture in the users hair beyond that which is necessary to adequately serve its purpose. Human hair follicles typically air capable of holding 30% percent their weight in water and medical tests have established that at least 10% by weight of moisture is desired in order for hair to maintain a healthy body. Electric hair dryers typically remove substantially all the moisture in the hair and, while this is according to its intended purpose, over drying beyond which is necessary can result in undesirable effects.

SUMMARY OF THE PRESENT INVENTION

The present invention is a moisturizing attachment for use with a hand held hair dryer for re-hydrating or adding moisture back into a user's hair by maintaining adequate levels of alkaline. The attachment is used with a conventional hand held hair dryer, the hair dryer having a handle portion and an air emitting nozzle portion. The attachment includes a body having a preferably cylindrical shape with a first end and a second end.

A selected end of the body is attached to the air emitting portion of the hair dryer and the body further incorporates a substantially hollowed flow-through interior which permits heated air issued from the dryer nozzle to be distributed through the attachment device. According to one preferred embodiment, the flow through means are provided by a combination of a centrally open aperture and an annular ring shaped portion which is concentrically arranged within the open interior of the attachment body and which itself further defines an interior cavity. The interior cavity of the ring shaped portion is accessible at opposite ends by respective first and second pluralities of apertured portions formed in outer planar faces of the ring shaped portion and a further third plurality of radially extending apertures extend from an inner annular surface of the ring portion and are likewise in communication with the ring portion interior cavity.

Moisturizing means are also provided for creating micro vapor mists within the heated air generated by the hair dryer and, in a first preferred embodiment, include a volume of pebble sized stones which are arranged within the interior cavity of the ring shaped portion within the attachment body and which are accessible to both the inlets and outlets of the flow through means. The attachment with enclosed moisturizing means is immersed in water for a predetermined period of time prior to the attachment being secured to the hair dryer and, upon being secured to the nozzle portion of the hair dryer, generates a plurality of micro vapors within the heated air stream which are transferred to the hair of the user. The great number of tiny water molecules within the micro vapors results in the creation of negative ions which cling to the user's hair and assist in replenishing moisture. The mixture of the moisturizing vapors with the heated air stream further results in the creation of infrared rays which, upon impacting the user's head, react with acid associated with the hair and, as a result, converts the acid into an alkaline of a desired factor and crucial for maintaining the hair in a moisturized state and provides a healthy shine.

According to further preferred embodiments, the attachment device includes a first end attachable to the hair dryer nozzle portion and a second narrowed end for issuing the heated air stream. The flow through means of one further preferred embodiment is provided entirely by a hollowed interior passageway and, disposed within the passageway, is a disc-shaped fibrous material. In another embodiment, a rectangular three dimensional shaped enclosure is secured within the hollow interior of the attachment within which is contained the moisturizing means. In either embodiment, the attachment device is again pre-immersed in water until the moisturizing means is thoroughly water sodden and then secured over the end of the hair dryer nozzle, whereupon the hair dryer is activated and the attachment device operates in a fashion as previously described in order to moisturize the user's hair.

BRIEF DESCRIPTION OF THE DRAWINGS

Reference will now be had to the attached drawings when read in combination with the following specification, wherein like reference numerals refer to like parts throughout the several views, and in which:

FIG. 1 is a view of the hair moisturizing attachment device according to a first preferred embodiment of the present invention;

FIG. 2 is an end view taken along line 2—2 of FIG. 1 and illustrating the moisturizing attachment with flow through means including a centrally open aperture and axially extending and outer circumferentially arranged channels;

FIG. 3 is a perspective view illustrating the moisturizing attachment according to the first preferred embodiment of the present invention;

DESCRIPTION OF THE PREFERRED EMBODIMENTS

Figure 4:
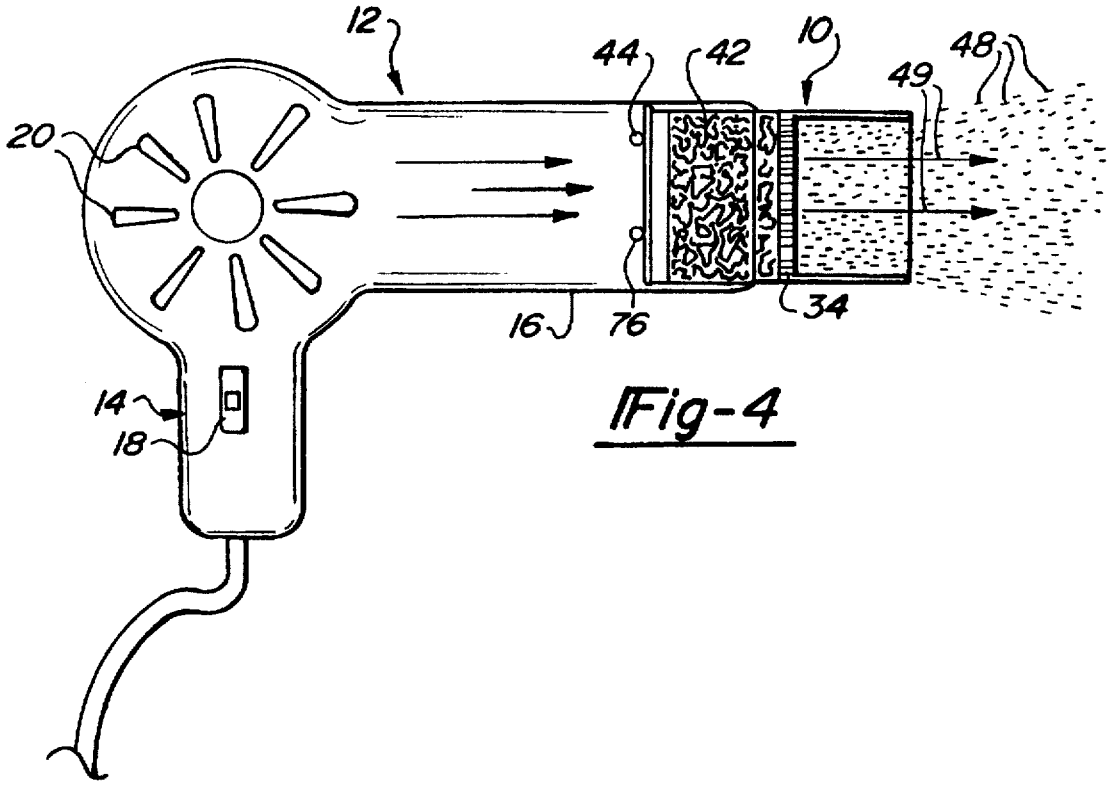
FIG. 4 is an operative view illustrating the moisturizing attachment according to FIGS. 1–3 secured to an air emitting nozzle portion of a hair dryer.

Referring now to FIG. 1, a moisturizing attachment 10 is illustrated for use with a conventional hand held hair dryer according to a first preferred embodiment. Referring also to FIG. 4, the hair dryer is illustrated at 12 and includes a handle portion 14 and an air emitting nozzle portion 16. An on/off button is shown at 18 and a plurality of intake vents at 20 which act as a vacuum to draw in air which is heated and subsequently discharged through the nozzle portion 16. Further reference will be subsequently made to FIG. 4 upon a description of the operative features of the attachment 10.

Referring again to FIG. 1, the attachment 10 includes a body 22 which is constructed of a preferably transparent and durable impact resistant plastic or other type similar material which exhibits the necessary properties of strength, impact resistance and low heat conductivity. The body 22 has a first selected end 24 and a second selected end 26. Referring again to FIGS. 1 and 3, the first selected end 24 is defined by an annular lip portion 28 of a desired thickness, preferably around 1.5 cm, which encloses a first substantially hollowed interior area, illustrated at 30 (FIG. 1).

As is best shown by viewing FIGS. 2 and 3 in combination, the second selected end 26 likewise includes an outer annular lip portion 32 and a recessed an inwardly concentric annular ring portion 34 which is partially inwardly spaced from the second selected end 26 (see also FIG. 1) and extends an axial distance within the body 22 of the attachment 10 until terminating in the first hollowed interior area 30. The annular ring portion 34 possesses a sufficient thickness and axial length such that it has a hollowed interior holding compartment or cavity for storing a quantity of a moisturizing means as will be subsequently described.

A first plurality of axially directed apertures 36 are formed circumferentially at desired spaced intervals around an exterior face of the annular ring portion 34 in proximity to the second selected end 26 and a second plurality of like apertures 38 are likewise formed in an opposing face of the ring portion in proximity to the first hollowed interior area 30. The open an annular ring shaped interior or cavity of the ring portion 34 is in communication with the first and second pluralities of apertures 36 and 38 and, as is best shown in FIG. 3, a further third plurality of radially extending apertures 40 are formed at spaced apart distances along an innermost circumferential surface of the annular ring portion 34 and communicate with the centrally open interior of the concentric portion 34.

Referring again to FIGS. 1 and 3, the moisturizing means according to the first preferred embodiment includes a volume of pebble sized natural stones 42 which are contained within the annular ring-shaped cavity enclosure of the annular ring portion 34 and which are accessible by the first, second and third pluralities of the apertures 36, 38 and 40. The attachment 10 with moisturizing means are first immersed in a fluid, preferably water, prior to them being affixed to the hair dryer nozzle. Upon removal from within the basin of fluid, such as is provided in a bathroom sink or the like, a small volume of the fluid (water) is trapped between in the spaces between the pebbles.

As is best illustrated in FIG. 4, the attachment 10 is dimensioned such that, in one preferred embodiment, it may be inserted within an open mouth of the hair dryer's air emitting nozzle portion 16. A pair of spacer members 44 and 46 are secured to the second selected end 26 of the attachment body 10 in a spaced apart and parallel manner and extend between opposing walls of the outer annular lip portion 32. The spacer members 44 and 46 assist in locating and positioning the attachment 10 upon mounting of the attachment 10 to the hair dryer 12 as illustrated in FIG. 4. It is also envisionable that either the first or second selected ends of the attachment 10 can be mounted to the hair dryer nozzle portion 16 and furthermore that either the annular lip portions 28 or 32 can be dimensioned so that they abut against either an inside or outside circumferential surface of the emitting nozzle portion of the hair dryer. It is further envisioned that the attachment could be provided with the hair dryer as a one-piece device with the moisturizing means being separately detachable and resecurable to the attachment body as is evident from FIG. 4.

Referring again to FIG. 4, a micro vaporized spray mist is illustrated at 48 which forms a part of the heated air discharge from the hair dryer 12 and moisturizing attachment 10. According to its most basic function, the attachment 10 issues the fine micro vapor spray 48 as a component of the heated air flow, illustrated by flow lines 49, which is sufficient to restore a minimal level moisture while drying the hair to give the hair a more healthy appearance. Statistically, human hair can hold 30% of its weight in water and at least 10% by weight water is desired within hair strands in order to maintain shine. Replenishing of hair moisture through use of the attachment assists in overcoming the negative effects of excessive blow drying and the use of chemicals such as permanent, colorant and bleach which tends to worsen the condition of hair strands.

The moisturizing means can additionally be modified to additionally provide the feature of increasing the alkalinity of the moisture in the user's hair and this is accomplished by use of infrared rays, such as are prevalent in volcanic rock, prior to immersing them in the fluid to encapsulate the moisture. Often called radiant heat, infrared radiation is defined as EM radiation with wave lengths of about 1 millimeter to 0.00075 millimeter (10 to the power of -3meter to 7.5×10 to the power of -7 meter). This is just within the red end of the visible-light spectrum of colors. The frequencies of infrared waves range from 100 billion to 100 trillion (10 to the power of 11 to 10 to the power of 14) hertz. In the present application, as the heated air flow generated by the hair dryer 12 passes through the moisturizing means, it becomes mixed with the entrapped water contained between the stones and results in the generation of micro vapors which contain a quantity of infrared rays. Stones origination from volcanic explosions will further emit infrared rays when exposed to heat or hot air and the use of a hair dryer accentuates the amount of infrared ray transferred on to the hair. The produced spray mist further incorporates negative ions such as are produced by a fountain to assist in maintaining freshness of the hair when a great number of tiny water vapor molecules are applied.

Figure 5:
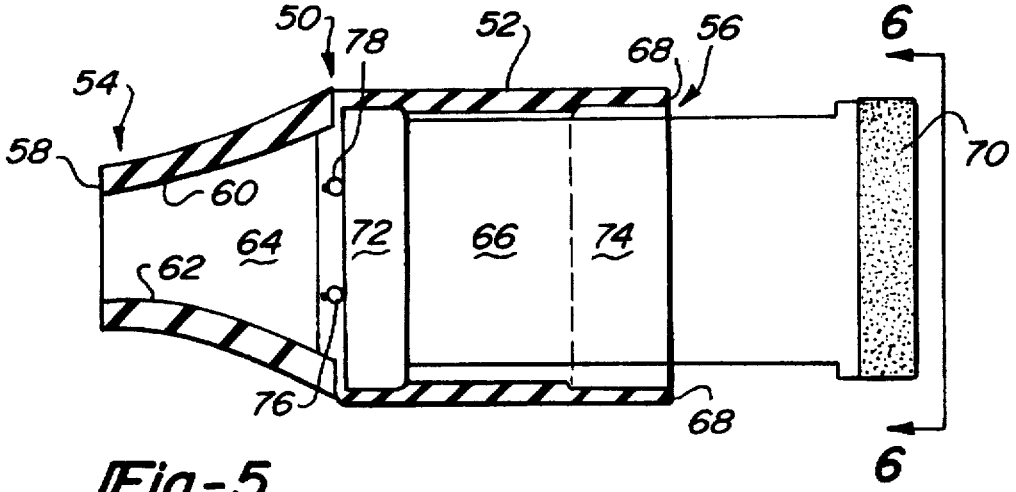
FIG. 5 is a view of a hair moisturizing attachment according to a second preferred embodiment of the present invention and further illustrating a disc shaped and fibrous moisturizing element.

Referring now to FIG. 5, a further preferred embodiment 50 is shown of a moisturizing attachment according to the present invention. The attachment 50 is constructed of a durable and transparent material as described in reference to the attachment 10 according to the first preferred embodiment and further includes a body 52 with a first selected end 54 and a second selected end 56. The first selected end 54 has an inwardly flared and nozzle shape portion which is formed by an annular lip portion 58 which is preceded by inwardly curved walls 60 and 62 to create a first hollowed interior cavity 64. The midsection of the attachment body 52 is substantially cylindrical in shape as illustrated in the attachment 10 with a hollowed interior 66 and the second selected end 56 of the embodiment 50 includes a narrowed annular lip 68 for mounting the attachment to a hair dryer nozzle as will be subsequently described. Also, while FIG. 5 illustrates a substantially side cutaway of the attachment device 50, it is understood that the device is substantially circular in cross section as shown in FIG. 6 with a continuous outer circular body.

Figure 6:
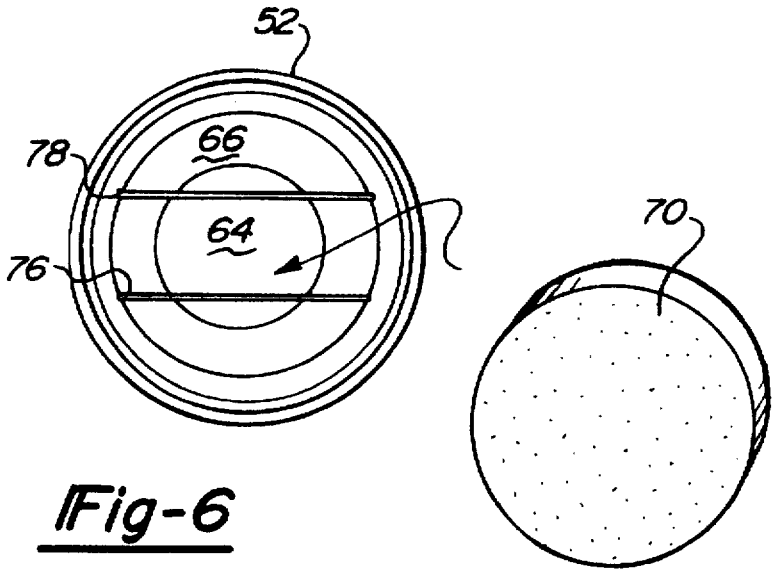
FIG. 6 is an end view taken along line 6—6 of FIG. 5 and illustrating the flow through means of the second preferred embodiment of FIG. 5.
Figure 7:
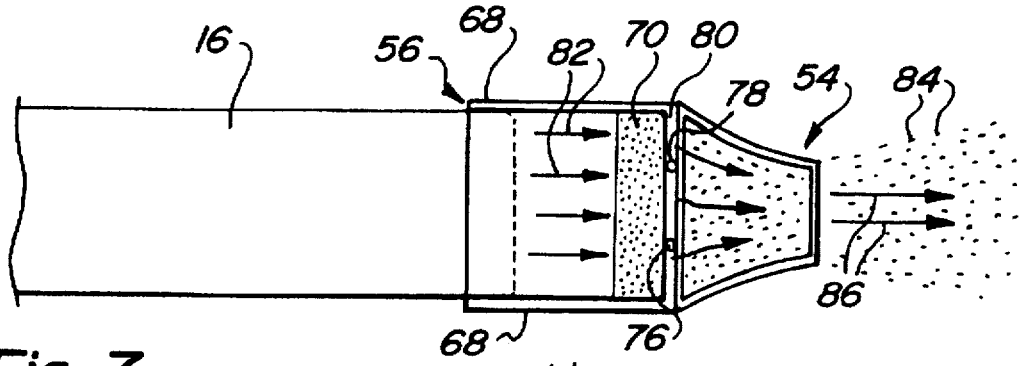
FIG. 7 is an operative view illustrating the moisturizing attachment according to FIGS. 5 and 6 secured to an air emitting nozzle portion of a hair dryer.

Referring again to FIG. 5, and also to FIGS. 6 and 7, a moisturizing means is provided in the further preferred embodiment and includes a disc-shaped and fibrous sponge-like member 70. The fibrous member 70 is of a sufficient dimension to permit it to be inserted within the open interior 66 of the attachment and positioned within a forward portion 72 thereof so that the narrowed annular lip 68 of the second selected end 56 may be mounted over the nozzle portion 16 of the hair dryer (shown in cutaway) as illustrated in FIG. 7. The fibrous member 70 may alternatively be mounted within a rearward portion 74 of the attachment body open interior (see FIG. 5) if it desirable to reverse attach the body 52 to the hair dryer nozzle and while this is not shown in the drawing for purposes of ease of illustration it may be accomplished assuming the dimensions between the hair dryer nozzle and engaging attachment body are suitable.

A pair of spacer members 76 and 78 are provided similar to those described in reference to the embodiment of FIGS. 1–4 and are arranged in a spaced apart and parallel fashion. As best seen from the cutaway of FIG. 5 and the end view of FIG. 6, the spacer members 76 and 78 are mounted within the open interior of the attachment body in order to space the fibrous member 70 a distance 80 within the attachment body a slight distance from the junction between the inwardly curved walls 60 and 62 so as to permit the generated air currents 82 shown in FIG. 7 to accumulate the micro vapors of mist 84 and redistribute them through additional air currents 86. The disc shaped member 70 is pre-immersed in a fluid bath, such as water or some other desirable fluid similar to the procedure described in FIGS. 1–4 as disclosed. The disc member 70 may be removed from within the attachment body prior to being immersed or, alternatively, the entire attachment device 50 with the inserted disc member 70 may be immersed within the fluid prior to being attached to the hair dryer nozzle portion.

Figure 8:
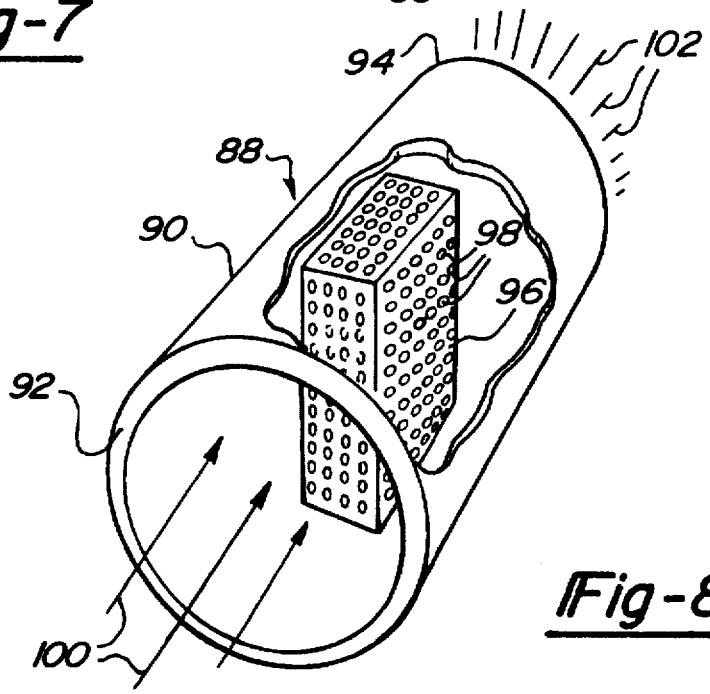
FIG. 8 is a view in perspective of a hair dryer moisturizing attachment device according to a further preferred embodiment of the present invention.

Referring now to FIG. 8, a further preferred embodiment 88 is shown of a moisturizing attachment for use with a conventional hand held hair dryer. Similarly to the embodiment 10 illustrated in FIGS. 1–4, the attachment 88 includes a body 90 which is generally cylindrical shaped and hollow and is further constructed of a transparent and durable impact resistant plastic or other type similar material. The attachment 88 attaches to the nozzle portion of a conventional hand held hair dryer in substantially the same fashion as the attachment 10 disclosed in the first preferred embodiment and includes a first selected end defined by an annular lip portion 92 and a second selected end defined by an annular lip portion 94.

The attachment 88 provides an alternative type moisturizing means as opposed to the annular cavity shaped portion best illustrated in FIG. 3. Specifically, the moisturizing means according to the further preferred embodiment includes a three dimensional rectangular shaped enclosure 96 which is secured to oppositely facing portions of the hollowed cylindrical shaped body so as to extend therebetween and to occupy a portion of the open interior of the attachment 88 through which the heated air flow is emitted from the hair dryer nozzle. An interior of the enclosure 96 is filled with a moisturizing medium, such as the plurality of pebble sized stones (not shown) for retaining volumes of fluid and releasing such fluid in the form of micro vapors upon actuation of the hair dryer. A plurality of apertures 98 are formed at spaced apart locations along the faces of the enclosure 96 and permit currents of heated air, indicated at 100, to pass both alongside the enclosure 96 as well as through the moisturizing interior in order to create micro vapors of mist 102 and to redistribute them in an outwardly spread pattern as illustrated.

Figure 9:
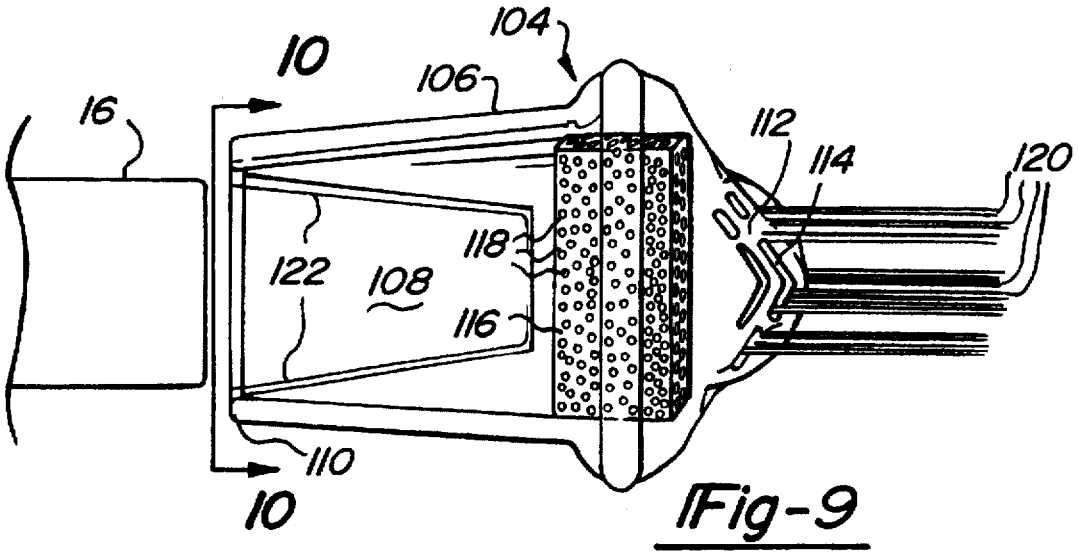
FIG. 9 is a side view of a hair dryer moisturizing attachment device with volumizing means according to a further preferred embodiment of the present invention.
Figure 10:
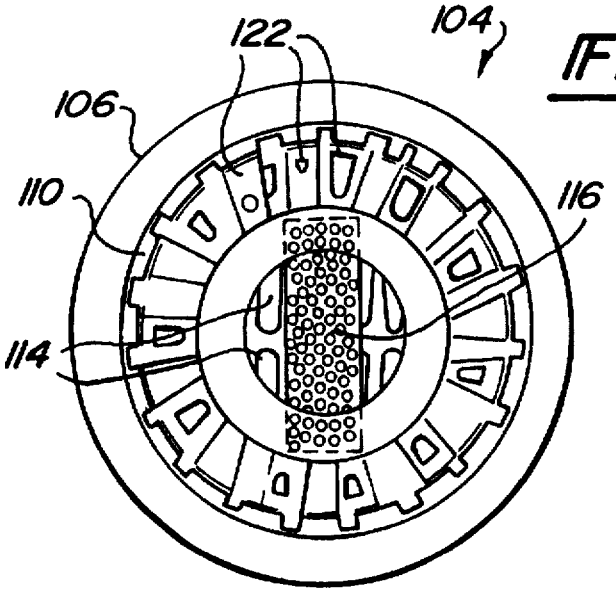
FIG. 10 is an end view taken along line 9—9 of FIG. 9 and illustrating the plurality of deflectable members in cylindrical array for engaging the hair dryer nozzle portion.

Referring finally to FIGS. 9 and 10, a yet further preferred embodiment 104 is shown of an attachment for attachment to the nozzle portion 16 of a hair dryer and which combines both the aspects of a moisturizer and volumizer into one convenient attachment. The attachment 104 is shaped somewhat similarly to the attachment 88 disclosed in FIG. 8 and includes a body 106 with a generally hollowed interior which is defined by an annular lip 110 at a first end and a generally bulbous shaped nose portion 112 at a second end, a plurality of spaced apart and channel shaped apertures 114 extending along the bulbous shaped nose portion 112 and in combination defining a passageway at a forward end for permitting flow through of the heated air currents and generated moisturizing means.

A three dimensional rectangular shaped enclosure 116 similar to that disclosed in FIG. 8 is likewise mounted to inner walls of the attachment body 106 and proximate a forward end so as to extend across the open interior of the attachment 104. A plurality of apertures 118 are spread out across the faces of the enclosure 116 similarly as in FIG. 8 for the purpose of permitting the heated air currents to flow through the interior of the enclosure 1 16 which contains a moisture retaining medium of pebbles, fibrous element or the like and to create the water vapor for moisturizing hair. To assist in volumizing, a plurality of elongated, spaced apart and parallel finger elements 120 are provided and extend forwardly from the bulbous shaped nose portion 112. In use, the fingers 120 translate through the hair of the user and permit both the heated air currents and re-moisturizing spray to be evenly applied.

Referring to FIG. 10, an illustration as to how the attachment 104 is secured to the hair dryer nozzle 16 is shown and includes a plurality of annularly arrayed, elongated and deflectable tang members 122. Referring again to FIG. 9 in combination with FIG. 10, the hair dryer nozzle 16 is inserted so that its outer annular surface contacts a corresponding inner annular surface of the annular lip 110 and, upon inward translational movement, outwardly deflects the inwardly biased tang members 122 in order to firmly engage the attachment to the end of the hair dryer nozzle portion. The end view of FIG. 10, in combination with FIG. 9, also illustrates the manner in which the moisturizing retaining enclosure 116 is arrayed within the interior of the attachment 104 to permit the flow through currents of air to acquire micro vapors of the moisture from within the enclosure and to redistribute them in a re-moisturizing spray.

While the water absorbing and moisturizing medium has been disclosed in the primary preferred embodiments to include either the volume of pebble-sized stones or the fibrous disk shaped member, it is understood that other types of suitable absorbing medium may employed, among them including cloth, cotton, chemical products and the like for the purpose of soaking up and subsequently re-supplying a water misting spray with the hair dryer discharge. The moisturizing attachment is furthermore operative according to the present invention either to simply replenish moisture directly to the user's head through the micro vapor mist intermixed with the heated air issued from the hair dryer or to furthermore convert acid associated with the user's hair into a more desirable alkalinity ph factor in combination with the moisture replenishing as previously described.

Having described my invention, further embodiments will become apparent to those skilled in the art to which it pertains without deviating from the scope of the appended claims.

We claim:

1. A moisturizing attachment for use with a hand held hair dryer, the hair dryer including a handle portion and an air emitting nozzle portion for producing a stream of heated air, said attachment comprising:

a three-dimensional and substantially hollowed internal body having a first end and a second end;

attaching means incorporated into one of said selected ends of said body for attaching said body to the air emitting nozzle portion;

said body including flow through means between said first end and said second end for permitting passage of heated air emitted from the nozzle portion; and moisturizing means contained within said body for producing micro vapors of moisture in the stream of heated air upon issuance from said body for replenishing a moisture content of a user's hair.

2. The moisturizing attachment as described in claim 1, said attaching means further comprising an annular extending lip portion arranged circumferentially around at least one of said first and second ends of said three dimensional attachment body.

3. The moisturizing attachment as described in claim 1, said body further comprising an internal and annular ring portion disposed between said first end and said second end, said ring portion having a first exterior face proximate and partially inwardly recessed from said second selected end of said body, a second exterior face proximate a hollowed interior of said body and an innermost circumferential surface, said ring portion being accessible to said flow through means and further exhibiting a width and dimension sufficient for forming an annular and ring-shaped interior hollowed cavity for storing a volume of said moisturizing means.

4. The moisturizing attachment as described in claim 3, said flow through means further comprising a substantially cylindrically shaped and centrally open hollow interior within said attachment body.

5. The moisturizing attachment as described in claim 4, said flow through means further comprising a first plurality of axially directed apertures formed along said first exterior face of said annular ring portion, a second plurality of axially directed apertures formed along said second exterior face and a third plurality of radially extending apertures formed along said innermost circumferential surface, said first, second and third pluralities of apertures communicating said flow through means with said hollowed interior of said annular ring portion.

6. The moisturizing attachment as described in claim 5, said moisturizing means further comprising a volume of pebble sized stones contained within said hollowed interior of said annular ring portion, said attachment body incorporating said moisturizing means capable of being immersed in a fluid so as to permit said stones to entrap therebetween a volume of said fluid prior to attaching said body to the hair dryer air emitting nozzle portion.

7. The moisturizing attachment as described in claim 6, micro vapors of moisture created by said volume of stones further incorporating a negatively ionized charge whereupon, during reaction with the hot pressurized air of the hair dryer, a plurality of infrared rays are produced to improve the freshness and moisturizing of the user's hair and scalp.

8. The moisturizing attachment as described in claim 1, said moisturizing means further comprising an disc shaped portion insertable within said body and positionable in contact with said flow through means.

9. The moisturizing attachment as described in claim 8, said disc shaped portion being constructed of a fibrous, sponge-like material capable of absorbing a volume of a fluid prior to be secured within said body.

10. The moisturizing attachment as described in claim 1, said attachment means further comprising a pair of spacer members mounted to said body for arranging said moisturizing means at a desired position relative to the heated air discharge of the hair dryer.

11. The moisturizing attachment as described in claim 1, said first end of said body further comprising an annular and inwardly curved wall terminating in a reduced diameter nozzle portion.

12. The moisturizing attachment as described in claim 1, said body being constructed of a transparent and impact resistant plastic.

13. The moisturizing attachment as described in claim 1, further comprising a three dimensional rectangular shaped enclosure secured within said hollow internal body, said enclosure being internally hollowed for holding a volume of said moisturizing means, a plurality of spaced apart apertures being arranged across a plurality of faces of said three dimensional enclosure and providing said flow through means for passage of said heated air emitted from the nozzle portion.

14. The moisturizing attachment as described in claim 13, said attachment further comprising a plurality of annularly arrayed, elongated and inwardly biased tang members extending around an interior of said attachment body proximate said first end, said tang members engaging a corresponding outer annular surface of the hair dryer nozzle and deflecting outwardly to an extent necessary to securably arrange said attachment in place over the hair dryer nozzle.

15. The moisturizing attachment as described in claim 14, said attachment further comprising a plurality of elongated spaced apart and parallel extending fingers which are arranged so as to extend from said second end of said attachment body, said fingers translating through the hair of a user to provide additional volumizing flow in combination with said moisturizing means for resupplying moisture.

16. A combination moisturizing attachment and portable hand held hair dryer, comprising:

said hair dryer including a handle portion and an air emitting nozzle portion, said nozzle portion being substantially cylindrically shaped;

said attachment including a three-dimensional and substantially hollowed cylindrical body having a first end and a second end, said first end being defined by an annular lip which is fixedly secured to said air emitting nozzle portion;

flow through means incorporated within said attachment for permitting passage of heated air emitted from said nozzle portion; and moisturizing means contained within said attachment for producing micro vapors of moisture in a stream of heated air upon issuance from said attachment for replenishing a moisture content of a user's hair.

* * * * *

UNITED STATES PATENT AND TRADEMARK OFFICE

CERTIFICATE OF CORRECTION

PATENT NO. : 5,761,824

DATED : June 9, 2998

INVENTOR(S) : Jung S. Moon and Tae Wha Lee

It is certified that error appears in the above-identified patent and that said Letters Patent is hereby corrected as shown below:

Column 1, line 24, delete "air" and insert --are--.

Column 2, line 65, delete "9-9" and insert -- 10-10 --.

Column 3, line 42, delete "an" and insert --and--.

Column 6, line 28, delete "1 16" and insert --116--.

Signed and Sealed this

Twelfth Day of January, 1999

*Attest:*

*Attesting Officer*

*Acting Commissioner of Patents and Trademarks*